US007748080B2

(12) United States Patent
Hottmann

(10) Patent No.: US 7,748,080 B2
(45) Date of Patent: Jul. 6, 2010

(54) HINGE AND CLOSURE DEVICE FOR REFRIGERATOR

(75) Inventor: Philip F. Hottmann, Madison, WI (US)

(73) Assignee: Sub-Zero, Inc., Madison, WI (US)

( * ) Notice: Subject to any disclaimer, the term of this patent is extended or adjusted under 35 U.S.C. 154(b) by 761 days.

(21) Appl. No.: 11/654,341

(22) Filed: Jan. 17, 2007

(65) Prior Publication Data

US 2008/0168618 A1 Jul. 17, 2008

(51) Int. Cl.
*E05F 1/00* (2006.01)

(52) U.S. Cl. ..... 16/72; 16/50; 16/54; 16/286

(58) Field of Classification Search ..... 16/49, 16/50, 54, 70–72, 80, 82, 374–377, 286, 16/287, 277; 312/401, 405, 319.1, 319.2, 312/325, 326, 329; 49/109, 399
See application file for complete search history.

(56) References Cited

U.S. PATENT DOCUMENTS 3,643,291 A * 2/1972 Clark ..... 16/289
3,722,031 A * 3/1973 Bourgeois ..... 16/317
4,151,681 A * 5/1979 Roberts ..... 49/382
4,215,449 A * 8/1980 Loikitz ..... 16/50
4,690,468 A * 9/1987 Lau ..... 312/291
4,843,680 A * 7/1989 Cress et al. ..... 16/289
4,864,691 A * 9/1989 Gidseg et al. ..... 16/312
4,955,569 A 9/1990 Hottmann
5,020,189 A * 6/1991 Grome et al. ..... 16/286
5,027,473 A 7/1991 Hottmann
5,040,857 A 8/1991 Mandel et al.
5,158,503 A 10/1992 Mitchell
5,220,747 A * 6/1993 Cherry et al. ..... 49/386
5,265,954 A * 11/1993 Keil ..... 312/405
5,271,652 A * 12/1993 Watanabe et al. ..... 296/36
5,272,789 A * 12/1993 Mitchell et al. ..... 16/291
5,471,709 A * 12/1995 Lanzani ..... 16/238
5,497,534 A * 3/1996 Caruso ..... 16/288
5,497,634 A 3/1996 Kojima et al.
5,522,656 A * 6/1996 Jenkins ..... 292/79
5,535,482 A * 7/1996 Grabber ..... 16/286
5,622,414 A * 4/1997 Artwohl et al. ..... 312/116
5,896,619 A 4/1999 Koopman
5,931,554 A 8/1999 Koopman
6,003,204 A * 12/1999 Roach et al. ..... 16/267
6,178,593 B1 * 1/2001 Carlson ..... 16/82
6,375,291 B1 * 4/2002 Nam et al. ..... 312/405
6,845,545 B2 1/2005 Han et al.

(Continued)

OTHER PUBLICATIONS

Sub-Zero Design Guide, 3758546 Rev-B, Sep. 2006, 84 pages.

*Primary Examiner*—Chuck Y. Mah
(74) *Attorney, Agent, or Firm*—Foley & Lardner LLP

(57) ABSTRACT

A refrigerator comprises a body defining a refrigerated enclosure, a door movable between a closed position and an open position, a hinge comprising a first member coupled to the body and a second member coupled to the door and pivotably coupled to the first member, and a closure mechanism configured to provide a varying force to the door depending on the position of the door relative to the body. The closure mechanism includes a guide slidably mounted in a slot on the first member, a biasing mechanism coupled to the first member, and a closer arm coupled to the door and to the biasing mechanism through the guide.

17 Claims, 6 Drawing Sheets

U.S. PATENT DOCUMENTS

| | | | | |
|---|---|---|---|---|
| 7,192,105 | B2 | 3/2007 | Jung | |
| 7,240,397 | B2 | 7/2007 | Han | |
| 2004/0237257 | A1 | 12/2004 | Pohl | |
| 2005/0022342 | A1 * | 2/2005 | Ham | 16/374 |
| 2005/0132535 | A1 | 6/2005 | Jang et al. | |
| 2005/0273974 | A1 | 12/2005 | Han | |
| 2006/0232176 | A1 | 10/2006 | Kim et al. | |
| 2006/0244351 | A1 | 11/2006 | Moon et al. | |

* cited by examiner

HINGE AND CLOSURE DEVICE FOR REFRIGERATOR

BACKGROUND

The present invention relates generally to the field of refrigerators, and more specifically, to a refrigerator having a hinge and closure device.

It is generally known to provide a hinge and closure device for refrigerators. Such a hinge and closure device is typically provided with a series of plate members attached to one or both of the refrigerator body and the refrigerator door, and may include a biasing mechanism such as a spring that provides a bias force tending to close the door, thereby assisting users in closing the door and preventing the refrigerator door from remaining in an open position.

However, typical hinge and closure devices have several disadvantages. For example, the hinge and closure devices often require several plates to be attached to the refrigerator door and/or the refrigerator body to provide both the pivoting hinge action and to permit proper functioning of a biasing device. The plates are typically oriented in a "stacked" position such that they lie one above another in a vertical direction. Having plates stacked in such a manner can be unsightly to users of the refrigerator and can create difficulties in fitting the refrigerator into the often limited areas available for installation (e.g., in a household kitchen).

Another disadvantage of typical hinge and closure devices is that they often provide no or very cumbersome door adjustment features. In order to ensure proper functioning of the refrigerator doors and avoid having crooked or otherwise improperly mounted refrigerator doors, refrigerator doors often require some adjustment during installation, even though the doors may have been initially adjusted by, for example, the manufacturer of the refrigerator. Often times, the adjustment features are in areas that are difficult to access, or may require that one or more of the doors be opened or removed from the refrigerator in order to properly adjust the doors, making the adjustment of the refrigerator doors a cumbersome process.

Yet another disadvantage of many typical hinge and closure devices is that the biasing mechanisms used provide a generally constant force, such that additional components, such as detents, etc., are required to maintain the door in an open position. It may be inconvenient to users trying to handle refrigerated items to also have to continuously prevent the door from closing, or to have to overcome the uneven resistance provided by detents, etc.

Accordingly, it would be advantageous to provide a hinge and closure mechanism that minimizes "stacking" of hinge plate components and provides a low profile for the hinge and closure device. It would also be advantageous to provide a hinge and closure device that provides for easy adjustability of the refrigerator doors without the need to open or remove the refrigerator doors. It would also be advantageous to provide a hinge and closure device that permits a door to remain open at certain desired positions, and provides a smooth transition to application of a closing force to the door.

Accordingly, it would be desirable to provide a hinge and closure device for a refrigerator having one or more of these or other advantageous features. To provide an inexpensive, reliable, and widely adaptable hinge and closure device that avoids the above-referenced and other problems would represent a significant advance in the art.

SUMMARY

One embodiment of the invention relates to a refrigerator comprising a body defining a refrigerated enclosure, a door movable between a closed position and an open position, a hinge comprising a first member coupled to the body and a second member coupled to the door and pivotably coupled to the first member, and a closure mechanism configured to provide a varying force to the door depending on the position of the door relative to the body. The closure mechanism comprises a guide slidably mounted in a slot on the first member, a biasing mechanism coupled to the first member, and a closer arm coupled to the door and to the biasing mechanism through the guide.

Another embodiment of the invention relates to an appliance comprising a body defining an enclosure, a door movable between a closed position and an open position, a hinge comprising a first member coupled to the body and a second member coupled to the door and pivotably coupled to the first member, a closure mechanism coupled to the first member configured to provide a force to the door, and at least one adjustment device having a first portion and a second portion, the first portion coupled to and stationary relative to the body and extending through an aperture in the first member, the second portion movable relative to the first portion to engage a wall portion of the aperture in the first member, wherein the engagement of the second portion to the first member is configured to adjust the position or orientation of the door.

Yet another embodiment of the invention relates to a hinge and closure device for an appliance comprising a hinge including a first member configured to be coupled to a body of the appliance and a second member configured to be coupled to a door of the appliance and pivotably coupled to the first member, and a closure mechanism. The closure mechanism includes a biasing mechanism coupled to the first member, and a closer arm coupled to the door and to the biasing mechanism. At least two of the first member, the second member, and the closer arm are coplanar.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

BRIEF DESCRIPTION

Figure 1:
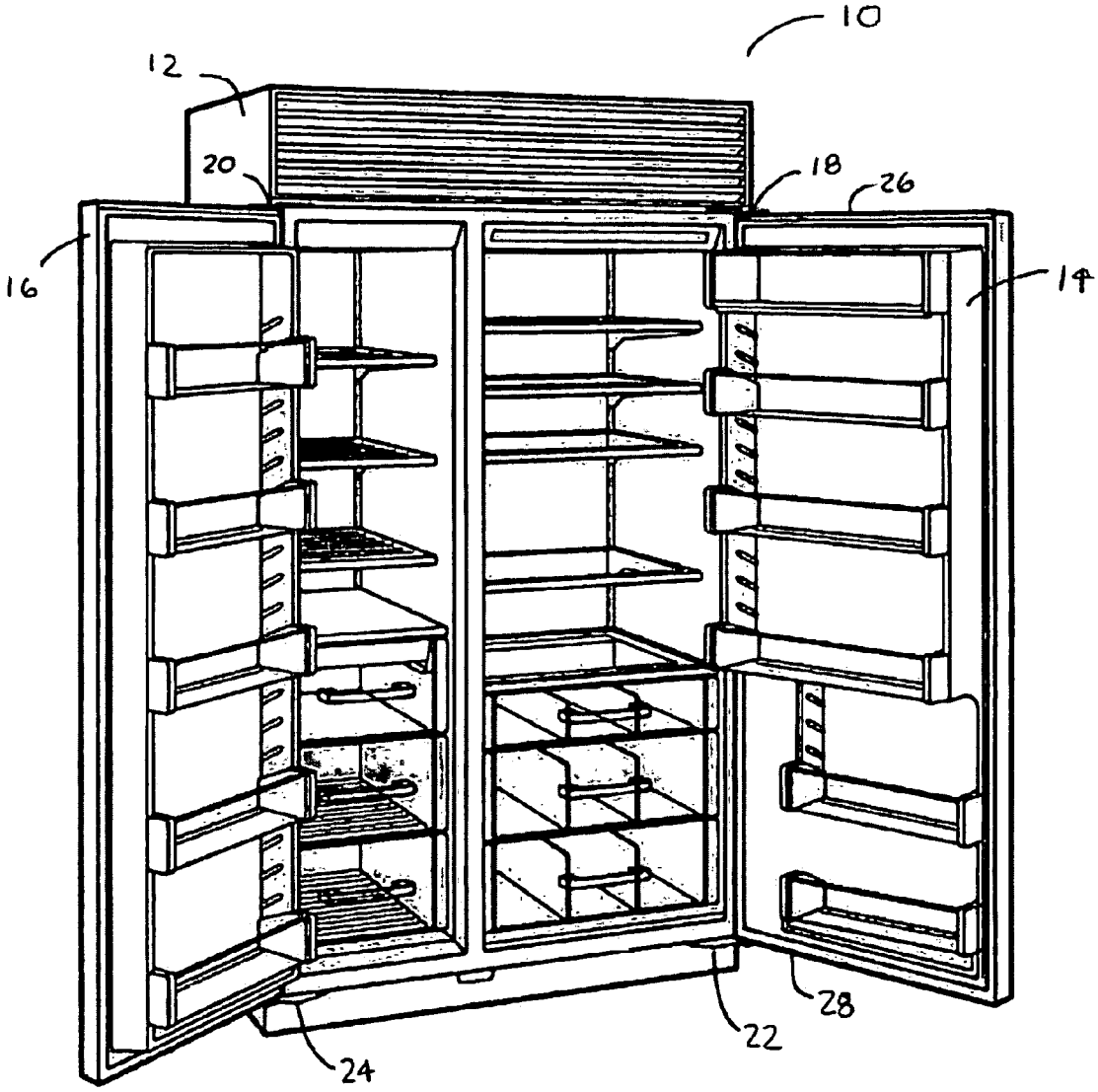
FIG. 1 is a perspective view of a refrigerator having a hinge and closure device according an exemplary embodiment.

Before explaining a number preferred, exemplary, and alternative embodiments of the invention in detail it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION

Referring to FIG. 1, a refrigerator 10 according to an exemplary embodiment is shown. Refrigerator 10 includes a body or body portion 12, and doors 14 and 16. Doors 14 and 16 are pivotally attached to body 12 by upper hinge assemblies 18, 20 and lower hinge assemblies 22, 24. For example, as shown in FIG. 1, a top portion 26 of door 14 is pivotally attached to body 12 via upper hinge assembly 18, and a bottom portion 28 of door 14 is pivotally attached to body 12 via lower hinge assembly 22. It should be understood that the teachings herein directed to only one hinge portion (e.g., upper hinge assembly 20) are equally applicable to the corresponding hinge portion on the opposite side of refrigerator 10 (e.g., upper hinge assembly 18). According to the embodiment illustrated in FIG. 1, refrigerator 10 is a side-by-side style refrigerator. According to various alternative exemplary embodiments, refrigerator 10 may comprise any of a variety of types or configurations of refrigerators, including a "top-bottom" style unit, a "chest" style unit, and so on.

Figure 2:
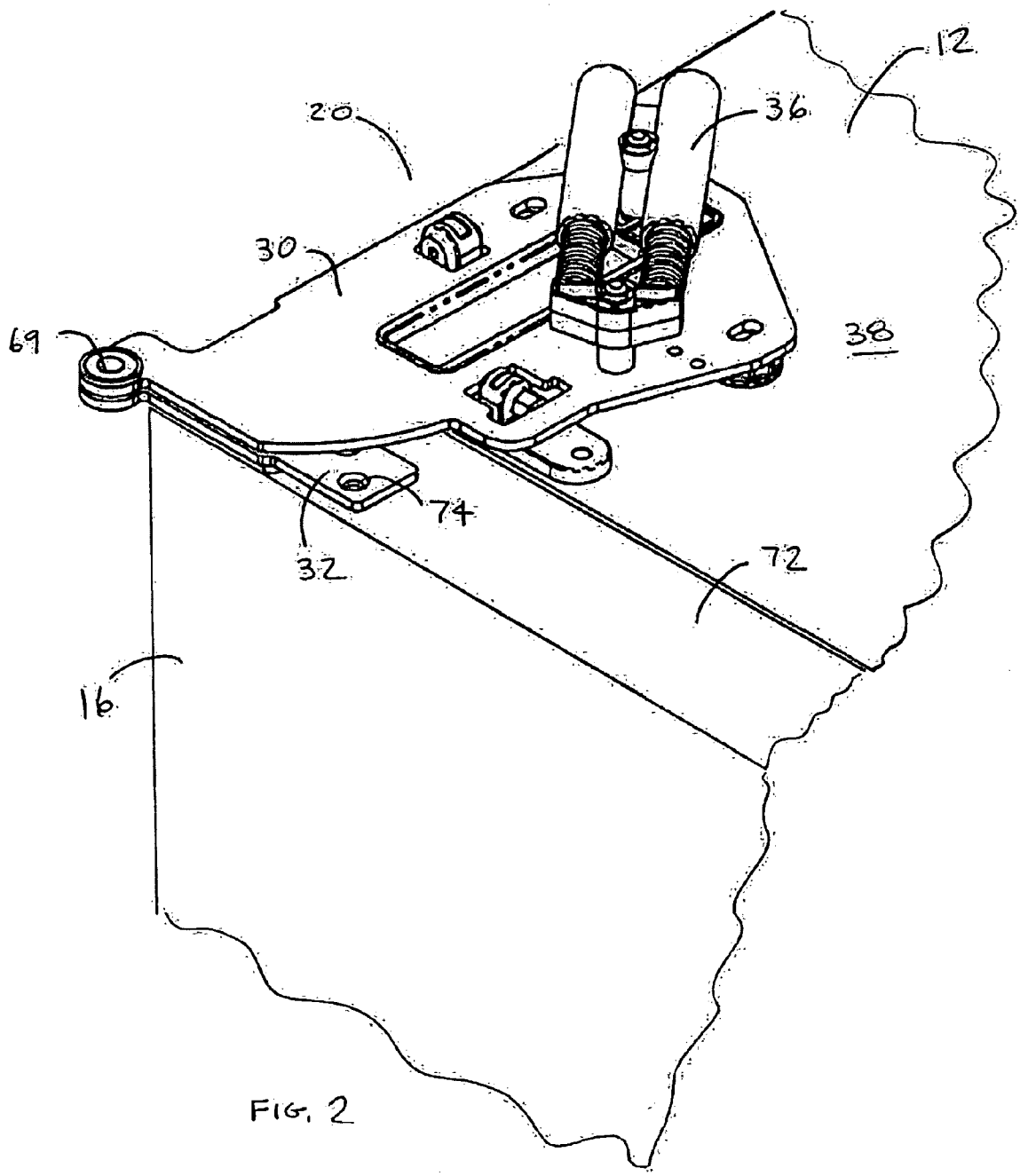
FIG. 2 is a partial perspective view of the refrigerator of FIG. 1 showing a hinge and closure device with the door in a closed position according to an exemplary embodiment.
Figure 3:
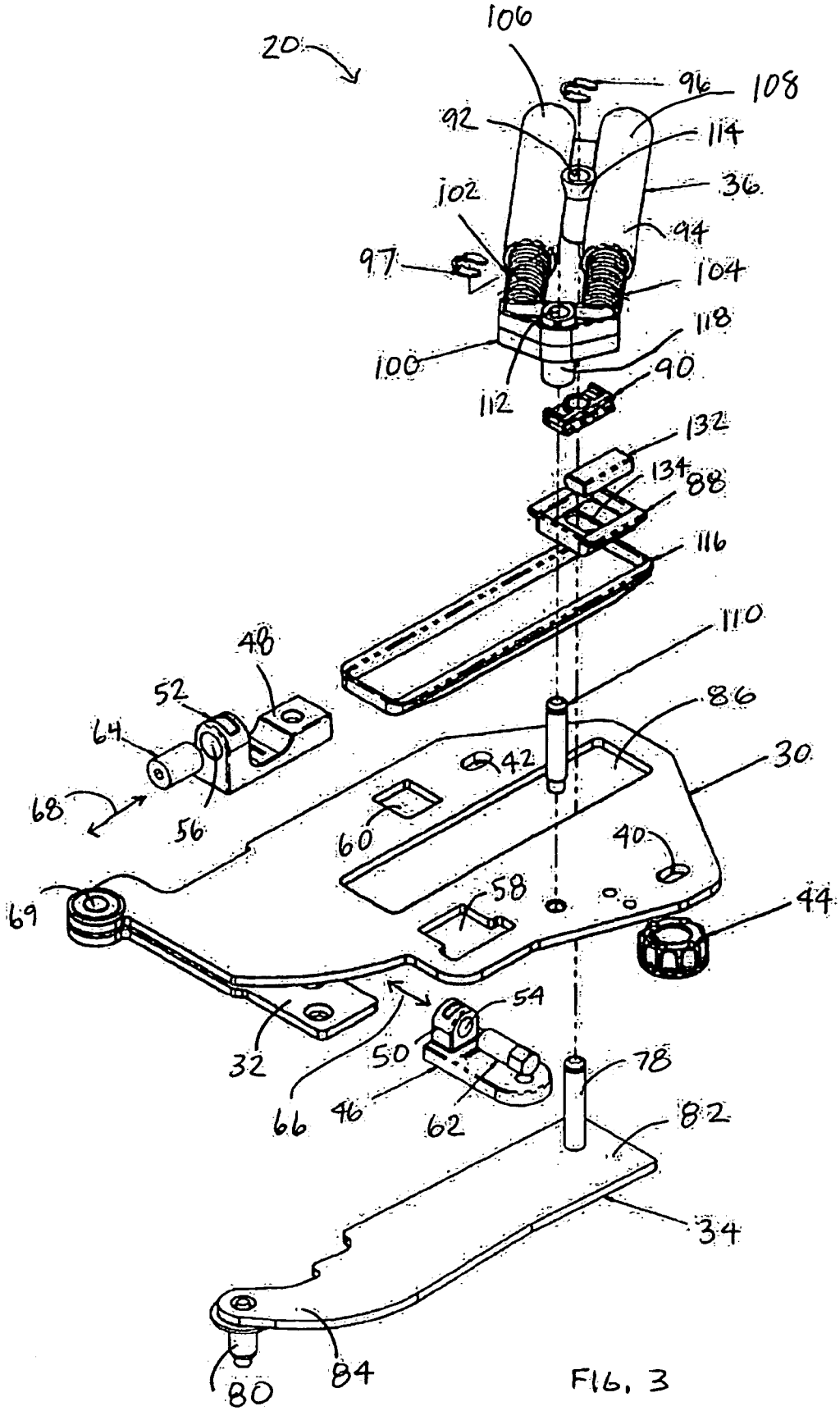
FIG. 3 is an exploded perspective view of the hinge and closure device of FIG. 2 according to an exemplary embodiment.

Referring now to FIGS. 2 through 6, upper hinge assembly 20 will be described in greater detail. As shown in FIGS. 2 and 3, hinge assembly 20 comprises an upper hinge plate 30, an upper door plate 32, a closer plate 34 (see FIG. 4), and a biasing mechanism 36 (e.g., a spring, a closure mechanism, etc.). Upper hinge assembly 20 acts both as a traditional hinge, providing a pivotal coupling between, for example, door 16 and body 12, and as a closer mechanism, providing a bias force to assist in closing, for example, door 16. Upper hinge plate 30 is secured to a top surface 38 of refrigerator 10 via two apertures 40, 42 (e.g., holes, slots, ovals, elongated holes, etc.). Any suitable fastener may be used to secure upper hinge plate 30 to refrigerator 10 (e.g., bolts, screws, etc.). A spacer 44 (e.g., a support member, washer, etc.) maintains the proper spacing between the lower surface of upper hinge plate 30 and top surface 38 of refrigerator 10 for the functioning of other components of upper hinge assembly 20.

Figure 4:
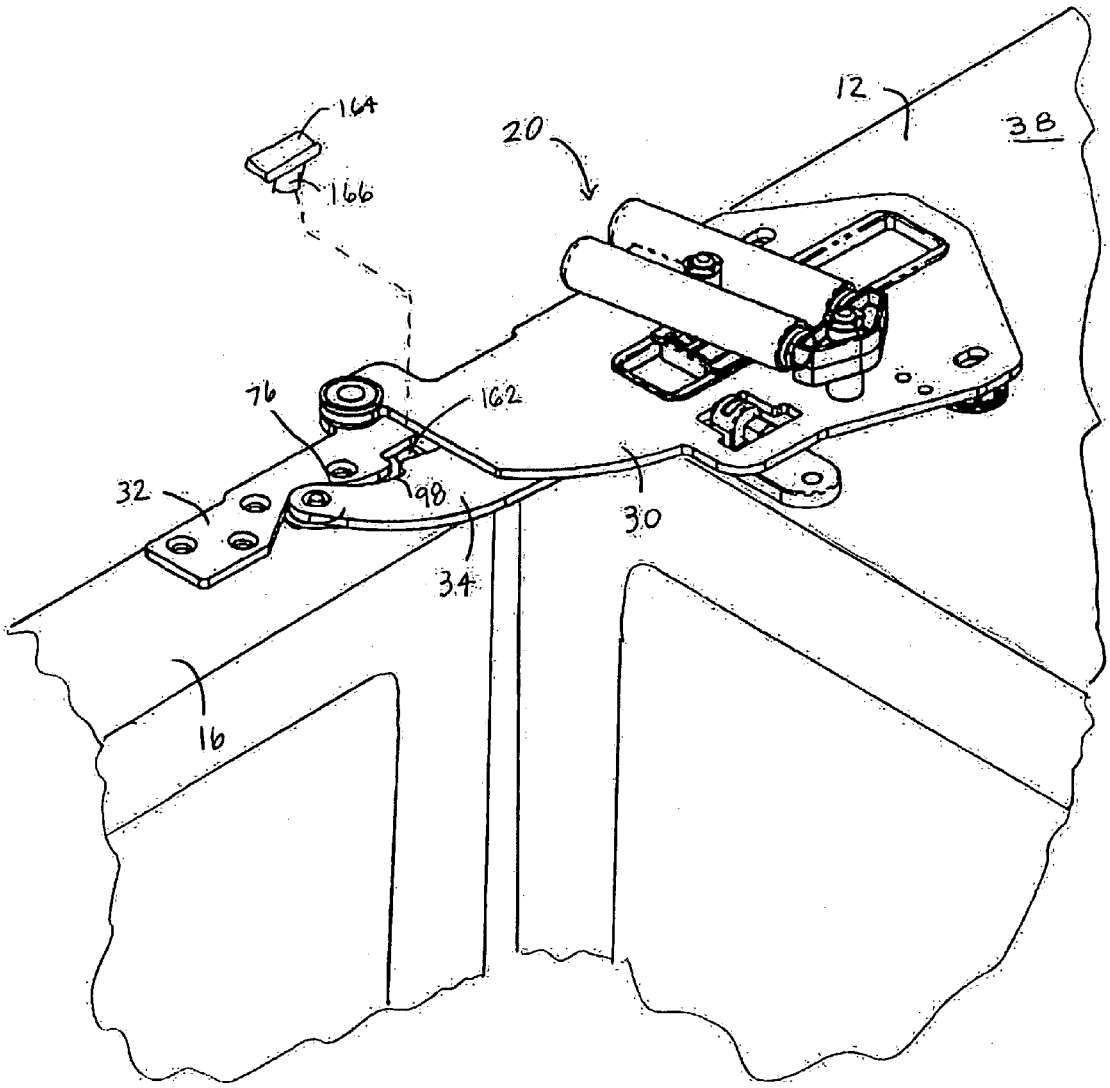
FIG. 4 is a partial perspective view of the refrigerator of FIG. 1 showing a hinge and closure device with the door in an open position according to an exemplary embodiment.

Referring further to FIGS. 2 and 3, a pivot member 69 pivotably couples upper hinge plate 30 and upper door plate 32. As shown in FIG. 2, upper door plate 32 is located below upper hinge plate 30 when upper hinge assembly 18 is secured to refrigerator 10. Upper door plate 32 is secured to door 16 via one or more apertures 74. Any suitable fastener (e.g., screws, bolts, etc.) may be used to fasten upper door plate 32 to door 16. As best shown in FIG. 4, upper door plate 32 is a shaped member having a curved or contoured portion 76 intended to permit proper functioning of door closer plate 34.

Referring to FIGS. 3 and 4, closer plate 34 is a generally flat plate member having an upward extending pin 78 affixed to a first end 82 and a downward extending pin 80 affixed to a second end 84. Pins 78, 80 may be fixedly or pivotally attached to closer plate 34. Closer plate 34 is pivotally secured to biasing mechanism 36 via pin 78. As shown in FIG. 3, pin 78 extends through a slot 86 in upper hinge plate 30 and further through a guide or sliding member 88 and a bumper 90. Pin 78 extends through a hole 92 in housing member 94 and is secured by a retainer ring or clip 96. According to one embodiment, pin 78 is secured at the approximate midpoint of housing 94. Pin 80 also extends into a corresponding receptacle (e.g., hole, recess, etc.) in door 16 such that end 84 of closer plate 34 moves with door 16 as door 16 is moved between a closed position (see, e.g., FIG. 2), and an open position (see, e.g., FIG. 4).

As best shown in FIG. 4, closer plate 34 includes a contoured portion 98 that is formed in a complimentary fashion to contoured portion 76 of upper door plate 32. As door 16 is opened, contoured portion 98 eventually engages contoured portion 76, thereby preventing further opening of door 16. According to one embodiment, upper door plate 32 and closer plate 34 are designed such that door 16 may be opened to a maximum of approximately 120 degrees from the closed position. According to various alternative embodiments, upper door plate 32 and closer plate 34 may be configured to permit door 16 to be opened to various other maximum positions. According to one embodiment shown in FIG. 4, an additional spacer plate 164 may be provided. Spacer plate 164 is generally coplanar with upper door plate 32 and closer plate 34 and is coupled to door 16 between upper door plate 32 and closer plate 34. A pin 166 extending from spacer plate 164 engages a corresponding hole, or aperture, 162, in door 16. Spacer plate 164 engages contour 98 such that the maximum open position of door 16 may be further reduced to, for example, 90 degrees from the closed position.

Figure 6:
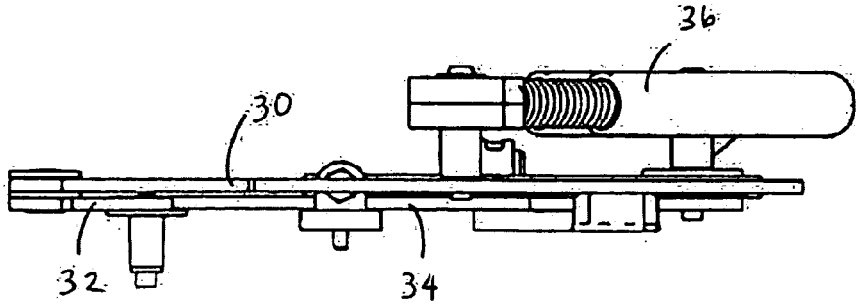
FIG. 6 is a side view of the hinge and closure device of FIG. 2.

It should be noted that, as best shown in FIGS. 4 and 6, upper door plate 32 and closer plate 34 are configured to act in a single plane. This type of configuration avoids having to stack upper door plate 32 and closer plate 34, for example, in a vertical configuration (as is typical in many traditional hinge and closer mechanisms), and minimizes the height profile of upper hinge assembly 20, thereby minimizing difficulties with installation of refrigerator 10 (e.g., due to bulky hinge mechanisms) and any potentially unsightly hinge components.

Referring further to FIGS. 2 through 4, biasing mechanism 36 will now be explained in greater detail. As shown in FIG. 3, biasing mechanism 36 includes a retainer or guide member 100 and two springs 102, 104. Springs 102 and 104 are supported by a pair of cylindrical tube-like projections extending from retainer member 100. According to one embodiment, springs 102, 104 are arranged in a "double barrel" configuration on either side of post 114, providing a balanced force for biasing mechanism 36. Housing 94 comprises a pair of tubular portions 106, 108, each being sized to slide over springs 102, 104 and each having one closed end to resist springs 102, 104, respectively. Springs 102 and 104 are located between retainer 100 and housing 94 such that as the distance between post 114 and post 118 decreases, springs 102, 104 compress, thereby creating a bias force tending to force post 114 away from post 118.

Figure 5:
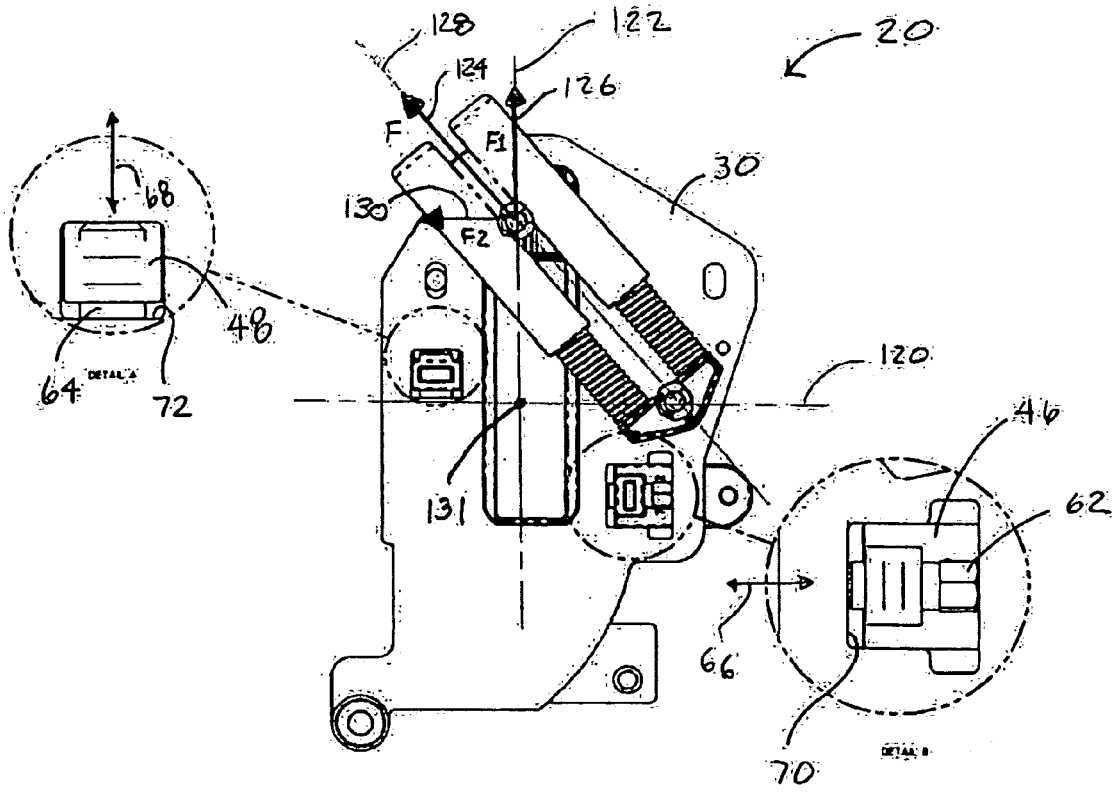
FIG. 5 is a top view of the hinge and closure device of FIG. 2.

Referring to FIG. 3, retainer 100 includes post 118 having a hole 112. Hole 112 engages a pin 110 that is secured to upper hinge plate 30, thereby permitting biasing mechanism 36 to rotate about pin 110. Housing 94 includes post 114 having hole 92. Hole 92 engages pin 78, pin 78 being secured to closer plate 34 at end 82. As door 16 is moved to an open position (see FIG. 4), door 16 moves closer plate 34, and thereby pin 78, outward relative to upper hinge plate 30, tending to rotate biasing mechanism about pin 110. As best shown in FIGS. 3 and 5, rather than pin 78, and therefore post 114, moving arcuately around pin 110, the movement of post 114 is restrained via sliding member or guide 88, which moves linearly along a track 116. As shown in FIG. 3, track 116 is a generally rectangular member that fits within and is secured to slot 86 in upper hinge plate 30. According to one embodiment, one or both of track 116 and guide 88 may include a frictional member (e.g., a surface, insert, pad, etc.) intended to provide a predetermined frictional force between track 116 and guide 88. Bumper 90 and a damper 132 are fitted within guide 88, and pin 78 passes through a hole or slot in guide 88 and through bumper 90 prior to passing through hole 92 in post 114. As closer plate 34 moves with door 16 between an open and closed position, guide 88 and post 114 move along track 116, thereby varying the distance between post 114 on housing 94 and post 118 on retainer 100. As discussed in more detail below, as the position of door 16 varies, the force applied to door 16 by biasing mechanism 36 also varies.

Referring to FIGS. 2, 4, and 5, the operation of upper hinge assembly 20 will now be discussed in greater detail. Referring to FIG. 2, door 16 is in the closed position, adjacent to body 12. When door 16 is in the closed position, guide 88 is positioned toward the rear of track 116 (e.g., in a direction away from door 16). According to one embodiment, when door 16 is in the closed position, a gap or space exists between guide 88 and the adjacent end of track 116. In this position, springs 102, 104, are compressed, providing a force F 124 (see FIG. 5) between posts 118 and 114 that tends to force guide 88, and therefore end 82 of closer plate 34, toward the rear of track 116, thereby assisting in keeping door 16 in the closed position. As shown in FIG. 5, springs 102 and 104 generate force F 124 along line 128. Force F 124 includes both a component F1 126 that is parallel to the direction of travel of guide 88 along track 116 (e.g., along line 122 shown in FIG. 5), and a component F2 130 that is perpendicular to the direction of travel of guide 88 within track 116 (e.g., parallel with line 120 shown in FIG. 5). Because guide 88 is restrained from moving perpendicular to track 116 (e.g., in a direction parallel with line 120 and force component F2 130), only force component F1 126 acts through post 114 upon closer plate 34 and therefore upon door 16. As can be seen in FIG. 5, as post 114 travels along track 116 and approaches line 120, force component F2 decreases until reaching substantially zero at approximately line 120 (e.g., at a position where door 16 may be open to 90 degrees with respect to the closed position.).

Thus, biasing mechanism 36 provides a varying force to door 16 that is dependent upon the position of door 16 relative to body 12. According to one embodiment, the force provided by biasing mechanism 36 is at a minimum when biasing mechanism 36 is at the over center position 131 (see FIG. 5) with respect to post 118, and the force provided to door 16 by biasing mechanism 36 increases as biasing mechanism 36 travels away from the over center position in either direction.

According to one embodiment, upper hinge assembly 20 is configured such that door 16 does not tend to open or close when at certain positions (e.g., between a 60 degrees open position and a 120 degrees open position). According to an exemplary embodiment, this is accomplished by configuring the components of upper hinge assembly 20 such that through a desired range of positions for door 16, the frictional resistive force created between guide 88 and track 116 (resulting from force component F2 130 resisting opening or closing movements of door 16) is greater than or equal to force component F1 126, which tends to force door 16 toward an open/closed position. For example, one or both of guide 88 and track 116 may be provided with a friction member designed to provide a predetermined friction force that varies with the normal force (e.g., F2 130) at the interface between track 116 and guide 88. Other means of providing a predetermined frictional force may be used according to various alternative embodiments.

As discussed above with respect to FIG. 4, the maximum open position of door 16 is defined by the interface between the door plate contour 76 and the closer plate contour 98. Even with such a limiting feature, in certain instances door 16 may be opened with such force as to create a jarring reaction upon not only upper hinge assembly 20, but also upon any contents that may be stored on or within door 16 or even within refrigerator body 12. According to one embodiment, to minimize the effects of such jarring actions, upper hinge assembly 20 is provided with bumper 90 and damper 132. As best shown in FIG. 4, once door 16 reaches a maximum open position, further effort to open door 16 will result in closer plate 34 transferring a force through pin 78 that tends to force guide 88 in a direction perpendicular to the direction of travel of guide 88 within track 116. Bumper 90 distributes the force transmitted through pin 78 to damper 132, and slotted aperture 134 in guide 88 permits pin 78 and bumper 90 to move toward and compress damper 132, thereby reducing the effects of any jarring forces applied to door 16. Damper 132 comprises a compressible material configured to absorb any forces transmitted by door 16 through closer plate 34 to pin 78. According to one embodiment, damper 132 is made of a rubber material. According to various alternative embodiments, damper 132 may be made of any suitable compressible material capable of providing the desire damping effect.

Upper hinge assembly 20 includes two adjustment blocks, or adjustment devices, 46, 48, that are mounted to top surface 38 of refrigerator 10. Adjustment blocks 46, 48 have raised portions 50, 52, respectively, each raised portion having a threaded hole 54, 56 extending thereto. Raised portions 50, 52 extend through apertures 58, 60, respectively, of upper hinge plate 30. Holes 54, 56 receive corresponding adjustment screws 62, 64 (e.g., moving members, set screws, etc.). Screws 62, 64 may be threaded into or out of adjustment blocks 46, 48 such that screws 62, 64 engage wall portion 70 of aperture 58 and wall portion 72 of aperture 60, respectively. Because adjustment blocks 46, 48 are fixedly attached to top surface 38 of refrigerator 10, as adjustment screws 62, 64 engage wall portions 70, 72, upper hinge plate 30 may be repositioned accordingly. Adjustment blocks 46, 48 and adjustment screws 62, 64 are used to adjust the position of upper hinge plate 30 in a side-to-side direction 66 and a front-to-back direction 68 (see FIG. 5).

It should be noted that these adjustments may be accomplished while refrigerator 10 is installed, and without the need to open or remove either of doors 14, 16 in order to complete the adjustment. In order to accommodate adjustments to, for example, door 16, the fasteners passing through apertures 40, 42 are loosened slightly. The elongated configuration of apertures 40, 42 permits upper hinge plate 30 to be repositioned using screws 62, 64 without the need to remove upper hinge assembly 20 and/or open or remove door 14. Further, adjustment blocks 46, 48 are positioned on top surface 38 of refrigerator 10 such that a user may easily adjust the position of door 16 from the front side of refrigerator 10.

Figure 7:
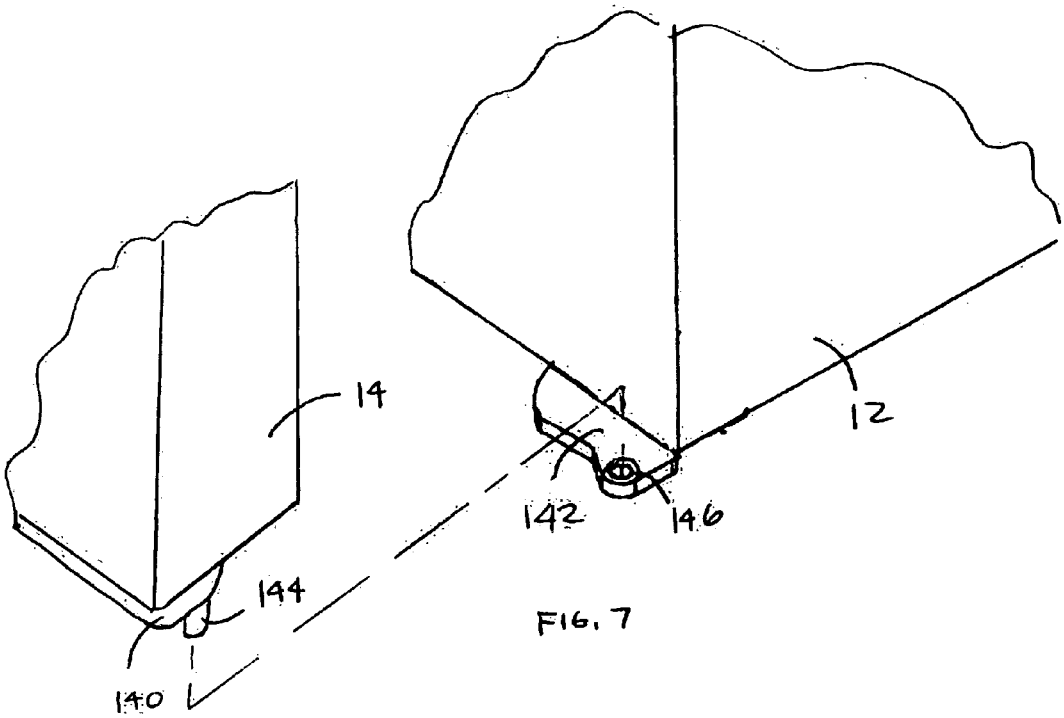
FIG. 7 is a an exploded partial perspective view of the refrigerator of FIG. 1 showing a lower hinge assembly according to an exemplary embodiment.
Figure 8:
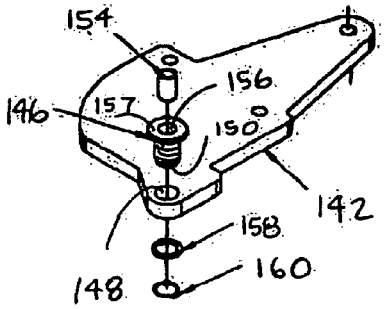
FIG. 8 is an exploded partial perspective view of the lower hinge assembly of FIG. 7.

Referring now to FIGS. 7 and 8, the construction and operation of lower hinge assembly 22 will be described in greater detail. Lower hinge assembly 22 comprises a lower door plate 140 that is coupled to the bottom of, for example, door 14, and lower hinge plate 142 that is coupled to, for example, the bottom of refrigerator body 12. Any suitable fasteners (e.g., bolts, screws, etc.) may be used to secure lower door plate to door 14 and lower hinge plate 142 to body 12. Lower door plate 140 includes a pin 144 that engages a corresponding insert 146 adjustably coupled to lower hinge plate 142 such that door 14 may pivot about pin 144 with respect to body 12 between a closed and an open position.

Referring to FIG. 8, lower hinge plate 142 will now be described in greater detail. As shown in FIG. 8, insert 146 is received in a hole 148 in lower hinge plate 142. A bushing 154 sits within hole 156 of insert 146 and provides a low-friction interface between insert 146 and pin 144. According to one embodiment, insert 146 and hole 148 have mating threaded portions such that the vertical position of insert 146 may be adjusted by threading insert 146 into or out of hole 148. Adjacent end 150 of insert 146, a washer 158 and retaining ring 160 prevent a user from threading insert 146 too far upward relative to hole 148 and lower hinge plate 142. According to one embodiment, insert 146 may be provided with a hexagonal recess on a bottom side 150 such that a tool may be inserted into the recess and the height of insert 146 adjusted with respect to lower hinge plate 142. Insert 146 includes a flange, or shoulder portion, 157 that extends about the perimeter of insert 146. Shoulder portion 157 supports door 16, and thereby controls the vertical position of door 16. Thus, vertical adjustment of door 16 may be accomplished through adjustment of insert 146. As with the adjustment features discussed with respect to upper hinge assembly 20, lower hinge assembly 22 provides advantages over many traditional hinge devices in that door 14 may be adjusted without opening or removal of door 14, and adjustment of the door requires only adjustment of insert 146.

As discussed with respect to the FIGURES, upper hinge assemblies 18, 20 and lower hinge assemblies 22, 24 are used in conjunction with refrigerator 10 (e.g., a household refrigeration unit, etc.). It should be understood that, according to various alternative embodiments, the teachings contained herein may be extended to a wide variety of other appliances, refrigerated appliances, and devices (e.g., freezer units, stove units, etc.). The term "refrigerated appliance" relates to appliances that have a cooled or chilled enclosure, including a combination refrigerator (e.g., cooled storage for fresh foods) and freezer, refrigerator (only), freezer (only), and having any of a variety of configurations or applications (e.g., side-by-side, over-under, under-counter, drawers, icemakers, wine storage, etc.).

It is important to note that for purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the hinge and closure device for refrigerator as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A refrigerator, comprising:

a body defining a refrigerated enclosure;

a door movable between a closed position and an open position;

a hinge comprising a first member coupled to the body and a second member coupled to the door and pivotably coupled to the first member; and a closure mechanism configured to provide a varying force to the door depending on the position of the door relative to the body, the closure mechanism comprising:

a guide slidably mounted in a slot on the first member;

a biasing mechanism pivotally coupled to the first member and the guide; and a closer arm pivotally coupled to the door at a first end of the closer arm and pivotally coupled to the biasing mechanism and the guide at a second end of the closer arm.

2. The refrigerator of claim 1, wherein the slot has a longitudinal axis substantially perpendicular to the door when in the closed position.

3. The refrigerator of claim 1, wherein the biasing mechanism is coupled to the closer arm by a first pin.

4. The refrigerator of claim 3, wherein the first pin extends through the guide and the slot.

5. The refrigerator of claim 1, wherein the closer arm is coupled to a middle portion of the biasing mechanism.

6. The refrigerator of claim 1, wherein the first member is coupled to an end of the biasing mechanism.

7. The refrigerator of claim 6, wherein the first member is coupled to the end of the biasing mechanism by a second pin.

8. The refrigerator of claim 1, wherein the biasing mechanism increases the force from a minimum force when the biasing mechanism is in a substantially perpendicular orientation to the slot to a maximum force as the biasing mechanism rotates away from the perpendicular orientation.

9. The refrigerator of claim 1, further comprising a damper coupled to the guide and configured to dampen forces transmitted from the door to the closure mechanism.

10. The refrigerator of claim 9, further comprising a bumper coupled to the guide and configured to distribute forces transmitted from the door along a length of the bumper.

11. The refrigerator of claim 1, wherein the biasing mechanism comprises a housing, a spring at least partially disposed in the housing, and a guide that engages the housing through the spring.

12. An appliance, comprising:

a body defining an enclosure;

a door movable between a closed position and an open position;

a hinge comprising a first member coupled to the body and a second member coupled to the door and pivotably coupled to the first member;

a closure mechanism pivotally coupled to the first member and configured to provide a force to the door; and at least one adjustment device having a first portion and a second portion, the first portion coupled to and stationary relative to the body and extending through an aperture in the first member, the second portion movable relative to the first portion to engage a wall portion of the aperture in the first member;

wherein the engagement of the second portion to the first member is configured to adjust the position or orientation of the door.

13. The appliance of claim 12, wherein the second portion comprises external threads configured to engage internal threads within a hole in the first portion.

14. The appliance of claim 12, further comprising:

a second adjustment device, the second adjustment device having a first portion and a second portion, the first portion of the second adjustment device coupled to and stationary relative to the body and extending through a second aperture in the first member, the second portion of the second adjustment device movable relative to the first portion to engage a wall portion of the second aperture in the first member;

wherein the engagement of the second portion to the first member is configured to adjust the door in a different direction from the first adjustment device.

15. The appliance of claim 12, further comprising:

a fastener, the fastener extending though an aperture in the first member and engaging the body;

wherein the at least one adjustment device may adjust the first member while the fastener extends through the first member and engages the body.

16. The appliance of claim 12, further comprising:

a second hinge comprising a third member coupled to the door and a fourth member coupled to the body, the fourth member including a third adjustment device and being pivotally coupled to the third member, the third adjustment device comprising:

an insert coupled to the fourth member, the insert being moveable relative to the fourth member to adjust the position or orientation of the door.

17. A hinge and closure assembly for an appliance, comprising:

a hinge comprising a first member configured to be coupled to body of the appliance and a second member configured to be coupled to a door of the appliance and pivotably coupled to the first member; and a closure mechanism configured to provide a force to the door, the closure mechanism comprising:

a biasing mechanism pivotally coupled to the first member; and a closer arm configured to be pivotally coupled to the door at a first end and pivotally coupled to the biasing mechanism at a second end;

a spacer configured to be coupled to the door and coplanar with the second member;

wherein an edge of the spacer and an edge of the closer arm engage to define a maximum open position of the door; and wherein at least two of the first member, the second member, and the closer arm are coplanar.

* * * * *